US008283550B2

(12) United States Patent
Chu

(10) Patent No.: US 8,283,550 B2
(45) Date of Patent: Oct. 9, 2012

(54) THIN KARAOKE HAVING DISPLAY DEVICE IN A BODY

(75) Inventor: Byung Cheon Chu, Seoul (KR)

(73) Assignee: SM Bravo Co. Ltd.

( * ) Notice: Subject to any disclaimer, the term of this patent is extended or adjusted under 35 U.S.C. 154(b) by 0 days.

(21) Appl. No.: 12/467,032

(22) Filed: May 15, 2009

(65) Prior Publication Data

US 2010/0288107 A1 Nov. 18, 2010

(51) Int. Cl.
*G10H 1/00* (2006.01)
*G10H 1/32* (2006.01)

(52) U.S. Cl. ..... 84/634; 84/477 R; 84/610; 84/644; 434/307 A

(58) Field of Classification Search ..... 84/634
See application file for complete search history.

(56) References Cited

U.S. PATENT DOCUMENTS

| | | | | |
|---|---|---|---|---|
| 5,993,220 | A * | 11/1999 | Nakamura et al. | 434/307 A |
| 6,328,570 | B1 * | 12/2001 | Ng | 434/307 A |
| 6,520,776 | B1 * | 2/2003 | Furukawa | 434/307 A |
| 6,563,038 | B2 * | 5/2003 | Kikuchi | 84/610 |
| 6,807,051 | B2 * | 10/2004 | Takahashi | 361/679.23 |
| 2005/0047069 | A1 * | 3/2005 | Chu | 361/681 |

* cited by examiner

*Primary Examiner* — Jeffrey Donels
*Assistant Examiner* — Christopher Uhlir
(74) *Attorney, Agent, or Firm* — Frost Brown Todd LLC

(57) ABSTRACT

The present invention relates to a thin karaoke machine, in which a display device, an amplifier and a karaoke machine are integrated into a single body. The thin karaoke system includes a front cover having an opening formed in a center thereof. A back cover is bent backwards to form an inner space in combination with the front cover, and has a plurality of heat radiation holes. A display panel is arranged on a back surface of the front cover and adapted to form a display part on a front surface. A display board is arranged on a first portion of the back surface of the display panel and has a plurality of electronic parts and PCBs. A karaoke board is arranged on a second portion of the back surface of the display panel and has a plurality of electronic parts and PCBs.

8 Claims, 5 Drawing Sheets

THIN KARAOKE HAVING DISPLAY DEVICE IN A BODY

FIELD OF INVENTION

The present invention relates, in general, to a thin karaoke system having a small thickness and, more particularly, to a thin karaoke system in which a display device, an amplifier and a typical karaoke machine are integrated into a single body.

BACKGROUND

Generally, a karaoke system installed in a karaoke room is constructed to include a karaoke machine, an amplifier and a display device. A karaoke machine is a device for storing the accompaniments and lyrics of songs and outputting the accompaniment and lyrics corresponding to a selected song when a desired song is selected. A display device is a device which is installed separately from the karaoke machine and is adapted to display moving images along with the lyrics of a song. An amplifier is a device for mixing the accompaniment sounds provided by the karaoke machine with signals input from a microphone, and adjusting the pitch, speed, echo and volume of sounds.

As shown in FIG. 1, in a conventional karaoke system 1, a karaoke machine 2, an amplifier 4 and a display device 6 are implemented as separate devices. Further, the conventional karaoke machine 2 and amplifier 4 are each formed in a box shape having a large thickness defined by the front and back surfaces thereof. Therefore, when the karaoke system 1 is installed in a karaoke room, it is installed in such a way that the karaoke machine 2 and the amplifier 4 are mounted in a separate cabinet 3, and the display device 6 is placed on the cabinet. In this way, the conventional karaoke system 1 is problematic in that, since the separate cabinet 3 must be installed in a small karaoke room, the interior space is further decreased and it is difficult to realize various interior designs.

Recently, in the karaoke system 1, a flat panel display device, such as a Liquid Crystal Display (LCD) or a Plasma Display Panel (PDP), has been used. Since a flat panel display device is thin, it is suitable for a small karaoke room. However, if the karaoke machine 2 and the amplifier 4, having the box shapes, are used, even through such a flat panel display device is used, the cabinet 3 for accommodating them must inevitably be used, and thus the effect of space reduction cannot be obtained. Further, when the flat panel display device is hung on the surface of the wall of a room and the cabinet 3 is removed, a separate shelf (7 of FIG. 5) for accommodating the karaoke machine 2 or the amplifier 4 must be embedded in the wall surface under the display device. Therefore, there is a problem in that the interior space is reduced in proportion to the size of the space in which the shelf 7 is embedded, and high construction costs are required.

SUMMARY

Accordingly, the present invention has been made keeping in mind the above problems occurring in the prior art, and an object of the present invention is to provide a thin karaoke machine integrated with a display device, in which a karaoke machine, an amplifier and a display device, which are implemented as separate devices, are integrated into a single device, thus enabling the karaoke system to be easily installed without requiring a cabinet or shelf for accommodating the karaoke machine or the amplifier, and thus efficiently utilizing the small space of a karaoke room.

In order to accomplish the above object, the present invention provides a thin karaoke system integrated with a display device, the system comprising a speaker and a microphone, comprising a front cover having an opening formed in a center thereof; a back cover bent backwards to form an inner space in combination with the front cover, the back cover having a plurality of heat radiation holes formed therein; a display panel mounted on a back surface of the front cover and adapted to form a display unit on a front surface thereof; a display board arranged on a first portion of a back surface of the display panel and provided with a plurality of electronic parts and Printed Circuit Boards (PCBs), which are electrically connected to the display panel and adapted to process externally applied video signals; and a karaoke board arranged on a second portion of the back surface of the display panel and provided with a plurality of electronic parts and PCBs, which are electrically connected to the display board and are adapted to store accompaniments and lyrics of songs, to adjust pitch, speed, echo and volume of accompaniment sounds, to mix accompaniment sounds with signals input through the microphone, and to output mixed results through the speaker.

Preferably, the karaoke board may comprise a main board for extracting an accompaniment sound and performing signal processing on the accompaniment sound when a song is selected, while processing data input through a key input unit, a hard disc for storing and outputting accompaniments and lyrics of songs or moving images, an amplifier for adjusting pitch, speed, and echo of accompaniment sounds and mixing the signals input through the microphone with the accompaniment sounds, and a power supply device.

Preferably, the display board and the karaoke board may be installed to be vertically slidably movable along guide rails installed on the back surface of the display panel, thus enabling repair and replacement thereof to be easily performed.

Preferably, the display board and the karaoke board may be installed to be vertically slidably movable along guide rails of a support plate fixed to the back surface of the display panel, thus enabling repair and replacement thereof to be easily performed.

Preferably, terminal plates, on which various types of terminals are formed, may be installed at lower ends of the display board and the karaoke board to be perpendicular to the display board and the karaoke board, respectively, and a perpendicular plate, in which accommodation holes for allowing the display board and the karaoke board to be inserted thereinto are formed to correspond to the display board and the karaoke board, may be installed below the back surface of the front cover.

As described above, a thin karaoke system integrated with a display device according to the present invention is implemented such that a karaoke machine, an amplifier and a display device, which are implemented as separate devices, are integrated into a single device, thus enabling the karaoke system to be easily installed without requiring a cabinet or shelf for accommodating the karaoke machine or the amplifier.

Further, the present invention is advantageous in that, since only a thin karaoke system is installed, the small space of a karaoke room can be efficiently utilized, and in that, since the system is hung on the surface of a wall, or is installed on a stand, various interior designs can be realized.

DESCRIPTION OF REFERENCE CHARACTERS OF IMPORTANT PARTS

Figure 1:
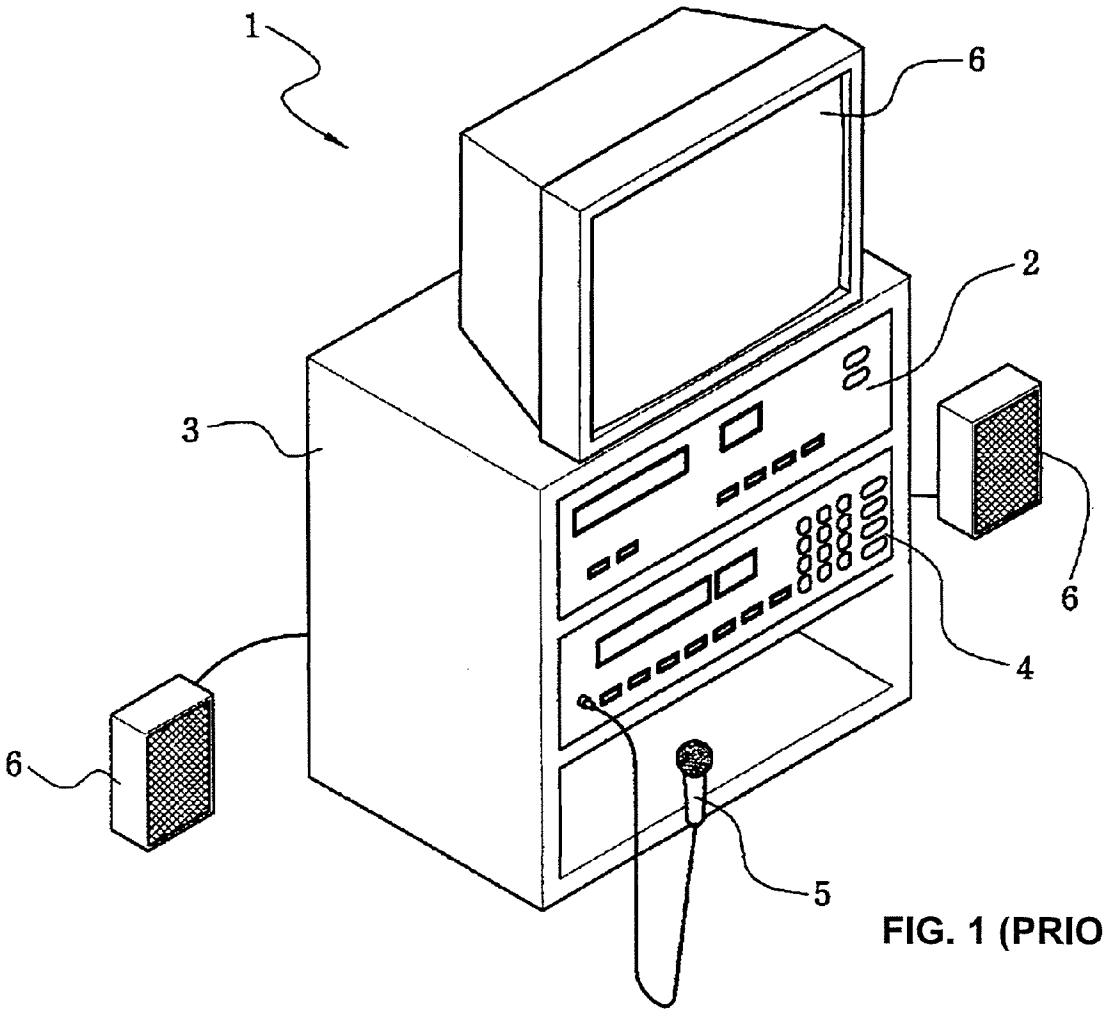
FIG. 1 (PRIOR ART)
FIG. 1 is a perspective view of a conventional karaoke system.

10: thin karaoke system of the present invention
11: front cover
21: display panel
31: support plate
41: display board
51: karaoke board
61: back cover
71: perpendicular plate

DETAILED DESCRIPTION OF THE PREFERRED EMBODIMENTS

Hereinafter, embodiments of a thin karaoke system integrated with a display device (hereinafter referred to as a 'thin karaoke system') according to the present invention will be described in detail with reference to the attached drawings.

Figure 2:
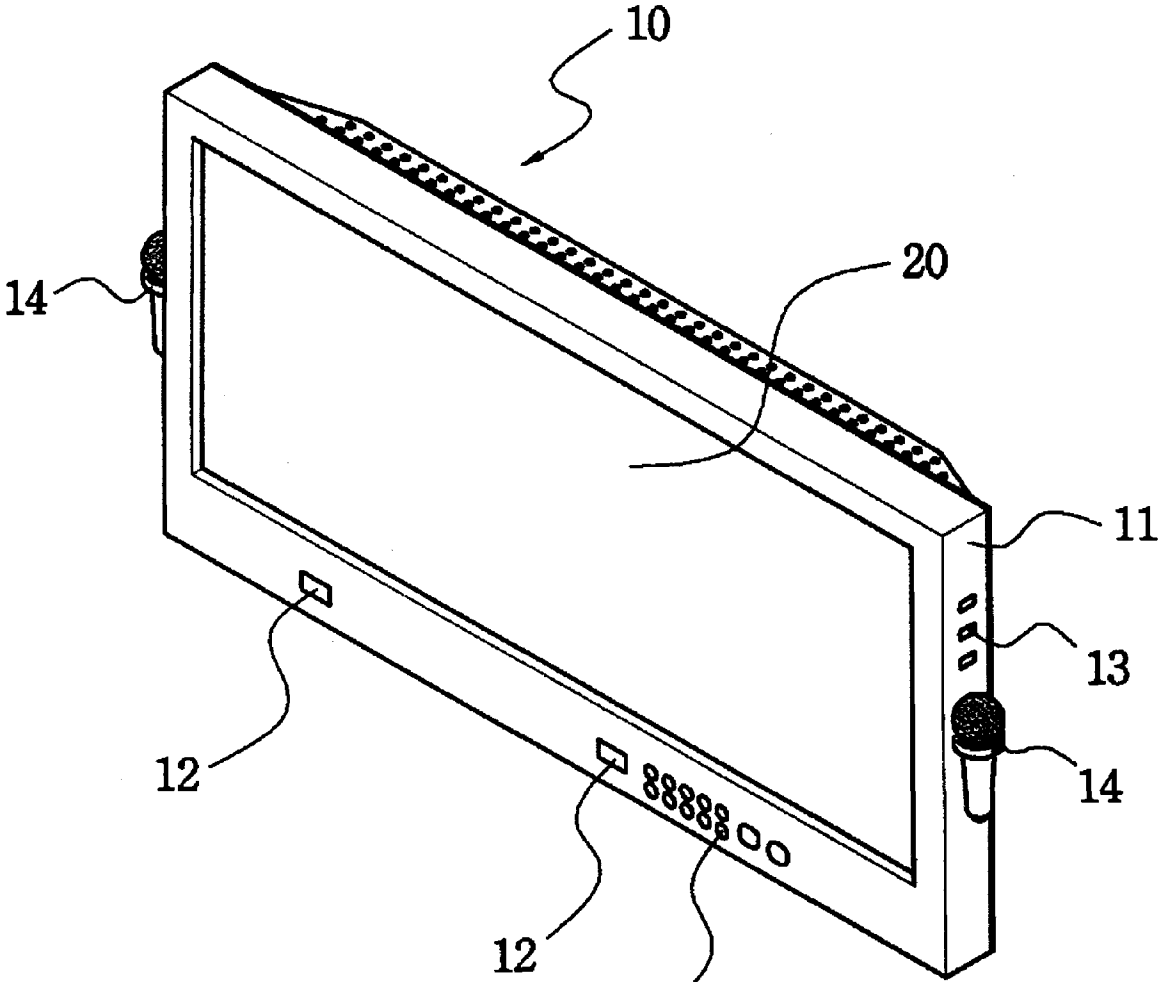
FIG. 2 is a perspective view of a thin karaoke system integrated with a display device according to an embodiment of the present invention.

First, as shown in FIG. 2, a thin karaoke system 10 is implemented such that a karaoke machine, an amplifier and a display device, which are implemented as separate devices, are integrated into a single device.

That is, in the thin karaoke system 10 of the present invention, a karaoke machine and an amplifier are included in a flat panel display device 20, so that a cabinet for accommodating the karaoke machine and the amplifier is not necessary, and so that the thickness defined by the front and back surfaces is minimized, thus not only efficiently utilizing the space of a karaoke room, but also realizing freedom of the interior design of a karaoke room when the thin karaoke system is hung on a wall, or is installed using a stand.

In detail, on the front surface of the thin karaoke system 10 of the present invention, a display device 20 for displaying the lyrics of songs and moving images is installed. The display device 20 of the present invention is a flat-panel display panel 21, such as a Liquid Crystal Display (LCD) or a Plasma Display Panel (PDP). Further, the display panel 21 includes parts such as a backlight or an inverter.

Further, on the front and side surfaces of the thin karaoke system 10, a remote control reception panel 12 for receiving signals from a remote control and various types of key buttons 13 for selecting TV channels and songs to be accompanied, a microphone holder 14 for allowing a microphone to be hung, etc. are installed. The thin karaoke system 10 is connected to one or more speakers 6.

Figure 3:
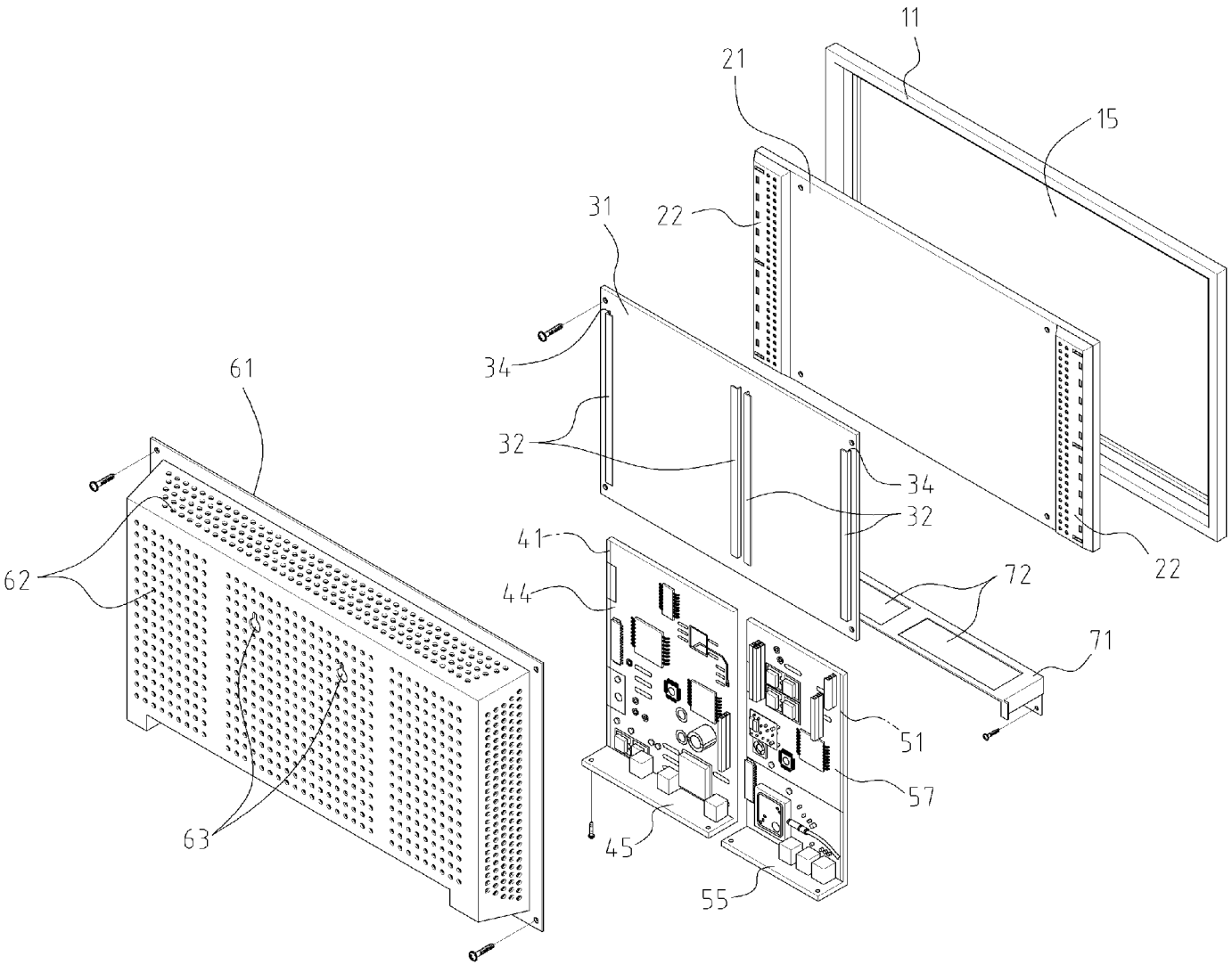
FIG. 3 is an exploded perspective view showing a thin karaoke system integrated with a display device according to the present invention.
Figure 4:
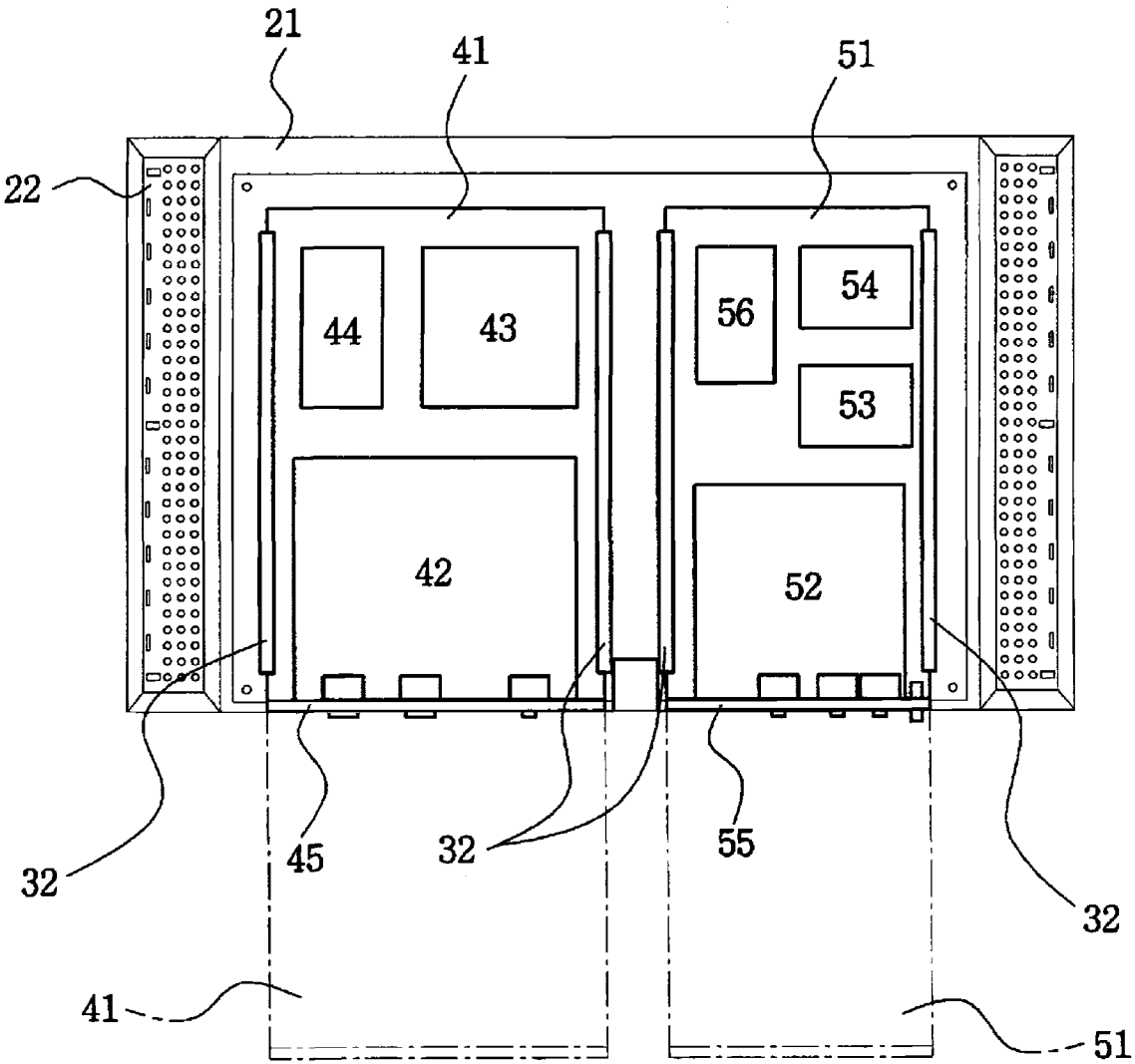
FIG. 4 is a plan view showing the construction of a thin karaoke system integrated with a display device according to the present invention.

Referring to FIGS. 3 and 4, in the thin karaoke system 10 of the present invention, the display panel 21, a display board 41 and a karaoke board 51 are installed in the inner space between a front cover 11 and a back cover 61. Reference numeral 31 denotes a support plate, as described below.

The front cover 11 is a frame body having an opening 15 formed in the center thereof to form a display window, and includes a support (not shown) for supporting the display panel 21. Further, a perpendicular plate 71 for allowing the display board 41 and the karaoke board 51 to be fastened thereto is installed below the front cover 11. The perpendicular plate 71 is coupled to the lower portion of the back surface of the front cover 11 through a bolt or screw, and has accommodation holes 72 respectively formed to allow the display board 41 and the karaoke board 51 to be inserted thereinto.

The back cover 61 is coupled to the back surface of the front cover 11 and forms the inner space in which the display panel 21, the display board 41, the karaoke board 51 and the support plate 31 are to be installed. The back cover 61 is implemented using a metal plate bent backwards to secure a sufficiently large space, and has a plurality of holes 62 formed to radiate heat generated in the display panel 21, the display board 41 and the karaoke board 51.

In the back cover 61, bracket holes 63 for allowing a wall-mounted bracket (8 of FIG. 5) to be fitted thereinto are formed. Further, a bending portion, bent upwards, is formed in the lower portion of the back cover 61, to enable easy connection of various types of cables, such as antenna, video, S-video, Digital Versatile Disc (DVD), Definition TV (DTV), Personal Computer (PC), microphone, and AC power lines.

Meanwhile, the display panel 21 has a thin planar shape and is fixed to the back surface of the front cover 11. On both side ends of the back surface of the display panel 21, heat radiation parts 22 are formed. Preferably, a backlight and an inverter for the backlight are installed on the heat radiation parts.

Next, the display board 41 and the karaoke board 51 are installed to be vertically slidably movable on portions of the back surface of the display panel 21. In this case, the display board 41 preferably includes an Analog/Digital (A/D) board 42 for a display panel. A terminal plate 45, on which various types of AV terminals are formed, is installed at the lower end of the display board to be perpendicular to the display board. A power supply device 43, a control board (OSD board) 44, and an inverter board and a TV tuner, which are not shown in the drawing, in addition to the AD board 42, can be installed on the display board 41.

Further, the karaoke board 51 installed on the other portion of the back surface of the display panel 21, includes a main board 52, an amplifier 53, a hard disc 54 and a power supply device 56 installed thereon. A terminal plate 55, on which various types of AV terminals and USB terminals are formed, is installed at the lower end of the karaoke board 51 to be perpendicular to the karaoke board 51. The main board 52 includes a microcomputer, memory, chipsets, etc., and processes signals, input from the key input unit, and accompaniment sound signals. Further, the hard disc 54 is auxiliary memory, and stores therein the accompaniments and lyrics of songs or moving images.

Meanwhile, the amplifier 53 is a digital amplifier. Since the digital amplifier directly receives digital audio signals, such as CD, DVD, Magnetic Disk (MD), MP3, and HDTV format signals, amplifies the audio signals in a digital manner without converting the digital audio signals into analog signals, and then outputs the digital audio signals to the speakers, a Digital to Analog Converter (DAC) is not required. Since the digital amplifier converts music signals into digital signals, and directly amplifies the digital signals, original sound can be reproduced unchanged, and the number of parts can be reduced to 1/10 of the number of parts of a conventional amplifier, so that micro-sized and lightweight products can be realized. Further, since less heat is generated, a thin package can be implemented.

As described above, both the display board 41 and the karaoke board 51 are preferably directly installed on the back surface of the display panel 21, but, in another embodiment of the present invention, they can be installed on the back surface of a separate support plate 31 fixed to the back surface of the display panel 21, as shown in FIG. 3. The support plate 31 is a thin metal plate, and is fixed to the back surface of the display panel 21, thus not only protecting the display panel 21, but also facilitating the installation of guide rails 32 for guiding both the display board 41 and the karaoke board 51.

The guide rails 32 are installed to be spaced apart from each other by a certain distance in order to vertically guide the display board 41 and the karaoke board 51. On the guide rails 32, guide grooves 34 are formed such that both side edges of the display board 41 and the karaoke board 51 are inserted into the guide grooves. Further, on both side edges of the display board 41 and the karaoke board 51, guide portions 44 and 57 to be inserted into the guide grooves 34 are formed.

Figure 5:
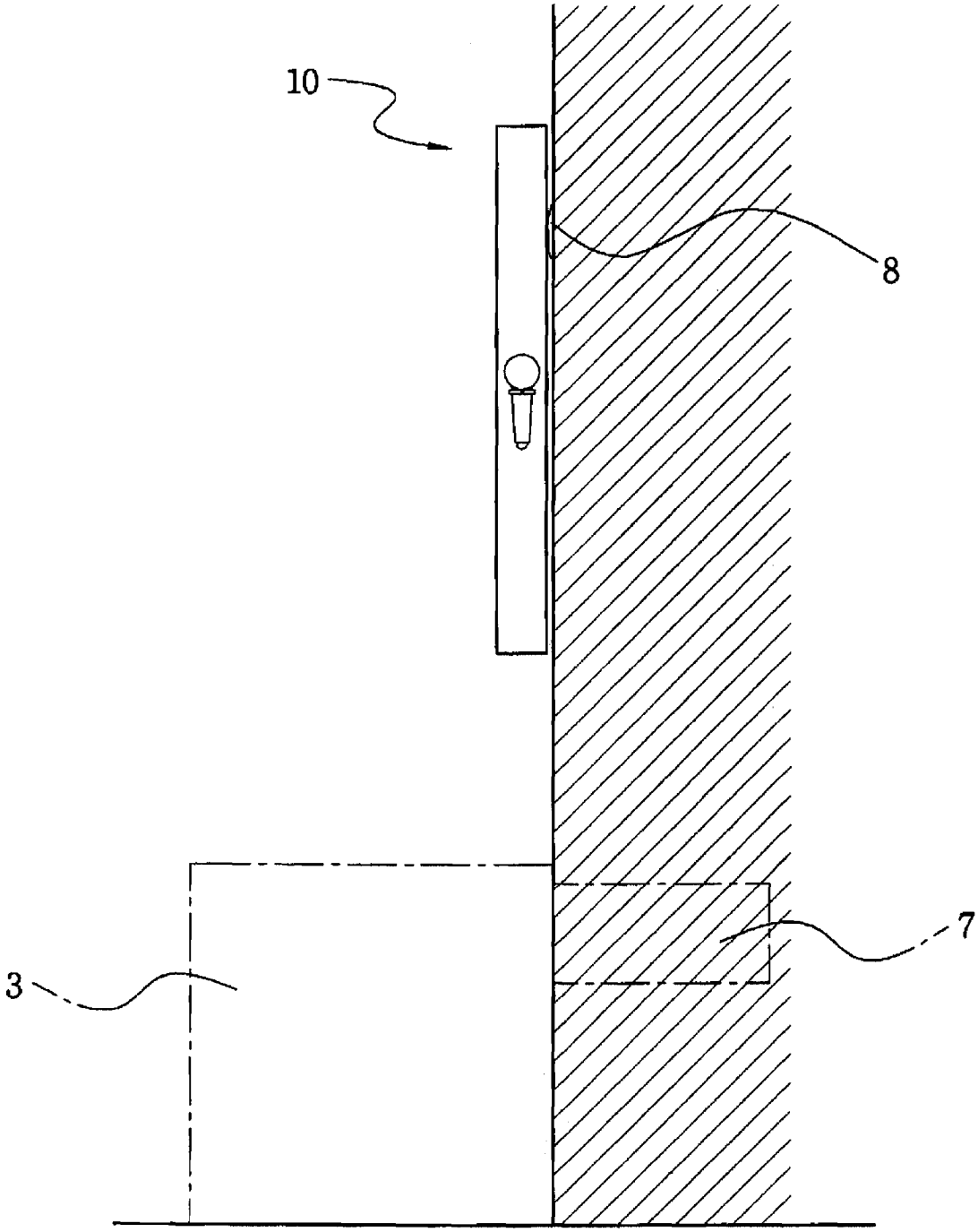
FIG. 5 is a sectional view showing the installation of a thin karaoke system integrated with a display device according to the present invention.

Therefore, the display board 41 and the karaoke board 51 of the present invention are vertically slidably movable along the guide rails 32. As described above, since the display board 41 and the karaoke board 51 are vertically slidably movable, both the display board 41 and the karaoke board 51 can be easily detached and repaired or replaced without removing the thin karaoke system 10 from the surface of a wall when the thin karaoke system 10 is installed on the wall surface, as shown in FIG. 5.

Meanwhile, the terminal plates 45 and 55 installed at the lower ends of the display board 41 and the karaoke board 51 to be perpendicular to the display board 41 and the karaoke board 51, respectively, are formed to have sizes greater than those of the accommodation holes 72 formed in the above-described perpendicular plate 71. Therefore, the terminal plates 45 and 55 are fastened to the perpendicular plate 71 through bolts or screws, thus enabling easy fastening of the display board 41 and the karaoke board 51.

Further, the AD board 42 of the display board 41 preferably includes a signal input unit and a signal processing unit. The signal input unit receives externally applied signals, and the signal processing unit controls and processes various types of input signals. The signals processed by the signal processing unit are output through the display panel 21 and the speakers. Further, the power supply device 43 is designed to process externally supplied power and to provide the processed power to respective elements.

That is, the signal input unit receives signals from antenna, video, S-video, DVD, DTV, PC, and AC power lines, and the signal processing unit is supplied with power by the power supply device for processing the power, supplied through the AC power line, and thus outputs the signals, provided by the signal input unit, through the display panel 21 and the speakers while classifying the provided signals into video signals and sound signals. Meanwhile, the signal processing unit provides the sound signals as audible sound signals through a sound IC and the speakers while displaying the video signals on the display panel 21, under the control of the microcomputer.

Further, signals input from the antenna are tuned by a tuner and are then processed as video signals through a video processor. Signals input from the DVD, DTV and PC lines are processed as video signals through an A/D converter. Such video signals are represented by video images on the display panel 20 under the control of a microcomputer.

Further, the karaoke board 51 includes the main board 52, the amplifier 53, the hard disc 54, and the power supply device 56 installed therein. The main board 52 receives externally applied input signals, reads the accompaniment and lyrics of a selected song or moving images, stored in the hard disc 54, when the song is selected, processes video and audio signals, displays the video signals on the display panel 21 through the display board 41 as video images, and outputs accompaniment sound through the amplifier 53 and speakers 6 as audible sound after signal processing is performed on the sound.

Further, the amplifier 53 adjusts the pitch, speed, echo and volume of the accompaniment sound read from the hard disc 54, mixes signals input through the microphone with the accompaniment sound, and then outputs the mixed results through the speakers 6.

As shown in FIGS. 3 and 4, the display board 41 and the karaoke board 51 have respective power supply devices 43 and 56 installed therein. However, in another embodiment of the thin karaoke machine of the present invention, only a single power supply device, capable of supplying power both to the display board 41 and to the karaoke board 51, can be implemented. Further, the karaoke board 51 of the present invention may be provided with a communication module capable of accessing the Internet, mobile phones, etc., thus receiving accompaniment sounds from various types of sound sources in a wired or wireless manner, or receiving accompaniment sounds from the thin karaoke system 10.

A thin karaoke system integrated with a display device according to the present invention is implemented such that a karaoke machine, an amplifier and a display device are integrated into a single device, so that the karaoke system can be easily installed without requiring a cabinet or shelf for accommodating the karaoke machine or the amplifier, thus efficiently utilizing the space in a karaoke room, and enabling realization of various interior designs. Therefore, conventional karaoke machines can be replaced in compliance with the requirements of consumers desiring karaoke rooms providing larger and more pleasant environments.

What is claimed is:

1. A thin karaoke system integrated with a display device, the system comprising a speaker and a microphone, comprising:

a front cover having an opening formed in a center thereof;

a back cover bent backwards to form an inner space in combination with the front cover, the back cover having a plurality of heat radiation holes formed therein; a display panel mounted on a back surface of the front cover and adapted to form a display unit on a front surface thereof;

a display board arranged on a first portion of a back surface of the display panel and provided with a plurality of electronic parts and Printed Circuit Boards (PCBs), which are electrically connected to the display panel and adapted to process externally applied video signals; and a karaoke board arranged on a second portion of the back surface of the display panel and provided with a plurality of electronic parts and PCBs, which are electrically connected to the display board and are adapted to store accompaniments and lyrics of songs, to adjust pitch, speed, echo and volume of accompaniment sounds, to mix accompaniment sounds with signals input through the microphone, and to output mixed results through the speaker, wherein the display board and the karaoke board are installed to be vertically slidably movable along guide rails installed on the back surface of the display panel, thus enabling repair and replacement thereof to be easily performed.

2. The thin karaoke system according to claim 1, wherein the karaoke board comprises a main board for extracting an accompaniment sound and performing signal processing on the accompaniment sound when a song is selected, while processing data input through a key input unit, a hard disc for storing and outputting accompaniments and lyrics of songs or moving images, an amplifier for adjusting pitch, speed, and echo of accompaniment sounds and mixing the signals input through the microphone with the accompaniment sounds, and a power supply device.

3. The thin karaoke system according to claim 1, wherein terminal plates, on which various types of terminals are formed, are installed at lower ends of the display board and the karaoke board to be perpendicular to the display board and the karaoke board, respectively, and wherein a perpendicular plate, in which accommodation holes for allowing the display board and the karaoke board to be inserted thereinto are formed to correspond to the display board and the karaoke board, is installed below the back surface of the front cover.

4. The thin karaoke system according to claim 1, wherein the display board and the karaoke board are supplied with power by a single power supply device.

5. A thin karaoke system integrated with a display device, the system comprising a speaker and a microphone, comprising:

a front cover having an opening formed in a center thereof;

a back cover bent backwards to form an inner space in combination with the front cover, the back cover having a plurality of heat radiation holes formed therein; a display panel mounted on a back surface of the front cover and adapted to form a display unit on a front surface thereof;

a display board arranged on a first portion of a back surface of the display panel and provided with a plurality of electronic parts and Printed Circuit Boards (PCBs), which are electrically connected to the display panel and adapted to process externally applied video signals; and a karaoke board arranged on a second portion of the back surface of the display panel and provided with a plurality of electronic parts and PCBs, which are electrically connected to the display board and are adapted to store accompaniments and lyrics of songs, to adjust pitch, speed, echo and volume of accompaniment sounds, to mix accompaniment sounds with signals input through the microphone, and to output mixed results through the speaker, wherein the display board and the karaoke board are installed to be vertically slidably movable along guide rails of a support plate fixed to the back surface of the display panel, thus enabling repair and replacement thereof to be easily performed.

6. The thin karaoke system according to claim 5, wherein the karaoke board comprises a main board for extracting an accompaniment sound and performing signal processing on the accompaniment sound when a song is selected, while processing data input through a key input unit, a hard disc for storing and outputting accompaniments and lyrics of songs or moving images, an amplifier for adjusting pitch, speed, and echo of accompaniment sounds and mixing the signals input through the microphone with the accompaniment sounds, and a power supply device.

7. The thin karaoke system according to claim 5, wherein terminal plates, on which various types of terminals are formed, are installed at lower ends of the display board and the karaoke board to be perpendicular to the display board and the karaoke board, respectively, and wherein a perpendicular plate, in which accommodation holes for allowing the display board and the karaoke board to be inserted thereinto are formed to correspond to the display board and the karaoke board, is installed below the back surface of the front cover.

8. The thin karaoke system according to claim 5, wherein the display board and the karaoke board are supplied with power by a single power supply device.

* * * * *